US005334471A

United States Patent [19]

Sacripante et al.

[11] Patent Number: 5,334,471

[45] Date of Patent: Aug. 2, 1994

[54] LOW GLOSS ENCAPSULATED COMPOSITIONS

[75] Inventors: Guerino G. Sacripante, Oakville; Grazyna Kmiecik-Lawrynowicz, Burlington; Beng S. Ong, Mississauga, all of Canada

[73] Assignee: Xerox Corporation, Stamford, Conn.

[21] Appl. No.: 907,989

[22] Filed: Jul. 2, 1992

[51] Int. Cl.[5] ..... G03G 9/083; G03G 9/093; G03G 9/097

[52] U.S. Cl. ..... 430/106.6; 430/110; 430/138

[58] Field of Search ..... 430/106.6, 138, 110; 252/62.54

[56] References Cited

U.S. PATENT DOCUMENTS

| | | | |
|---|---|---|---|
| Re. 33,172 | 2/1990 | Gruber et al. | 430/39 |
| 4,379,825 | 4/1983 | Mitushashi | 430/111 |
| 4,514,268 | 4/1985 | DeAngelis | 204/67 |
| 4,520,091 | 5/1985 | Kakimi et al. | 430/110 |
| 4,581,312 | 4/1986 | Nakahara et al. | 430/102 |
| 4,609,607 | 9/1986 | Takagi et al. | 430/106.6 |
| 4,698,289 | 10/1987 | Aldrich et al. | 430/106.6 |
| 4,740,443 | 4/1988 | Nakahara et al. | 430/110 |
| 4,795,698 | 1/1989 | Owen et al. | 435/4 |
| 5,135,832 | 8/1992 | Sacripante et al. | 430/106.6 |

OTHER PUBLICATIONS

*Manual of Mineralogy*, Klein and Hurlbut, John Wiley and Sons, New York, N.Y., pp. 310–311, (1985).

*Primary Examiner*—Christopher D. Rodee
*Attorney, Agent, or Firm*—E. O. Palazzo

[57] ABSTRACT

A toner composition comprised of a core comprised of a polymer resin or resins, low remanence-magnetite of from between about 0.1 to about 8 gauss with an average volume particle diameter of from between about 2 to about 6 microns, and a light scattering component with an average particle diameter of from between about 2 to about 6 microns; and which core is encapsulated in a polymeric shell.

10 Claims, No Drawings

LOW GLOSS ENCAPSULATED COMPOSITIONS

BACKGROUND OF THE INVENTION

The present invention is generally directed to toner compositions and processes thereof, and more specifically, to encapsulated toner compositions and processes thereof, and wherein in embodiments toners can be directly generated without resorting to the conventional pulverization and classification methods. In one embodiment, the present invention relates to encapsulated toner compositions which display low gloss levels of, for example, from about 0.1 gloss unit to about 25 gloss units, and more preferably from about 1 gloss unit to about 14 gloss units, as measured by the GARDNER TM gloss unit apparatus. In another embodiment, the present invention relates to cold pressure fixable encapsulated toners of low remanence and low gloss, such as a remanence value of from about 0.01 gauss to about 5 gauss as measured using a Half-Effect device of a Gaussmeter such as the F. W. BELL GAUSSMETER TM and low gloss value of from about 1 gloss unit to about 15 gloss units. In another embodiment, the present invention relates to cold pressure fixable encapsulated toners of low gloss, and low remanence and of fine particle sizes of from about 11 microns to about 21 microns in volume average diameter, and more preferably from about 13 microns to about 15 microns volume. diameter, as measured by a Counter Counter. In another embodiment, the present invention relates to colored encapsulated toner compositions which display low fixing temperatures of from about 25° C. to about 60° C., and high fixing pressure of from about 2,000 pounds per square inch to about 4,000 pounds per square inch, thereby reducing the energy consumption of an electrostatographic imaging or printing apparatus and prolonging the lifetime of the reprographic engine. The encapsulated toners of the present invention in embodiments are comprised of a core comprised of a polymer resin and colorants, including color pigments, dyes, or mixtures thereof, and especially low remanence magnetites with, for example, diameters of from about 0.5 to about 10, and preferably 1 to 6 microns, and a light scattering components, and thereover a polymeric shell of, for example, a polyurea, a polyurethane or a polyester and the like. The processes of the present invention in embodiments thereof are comprised of an initial dispersion step for forming a stabilized organic microdroplet suspension comprised of low remanence magnetite, free-radical monomers, a deglossing agent like titanium oxide, and a shell forming monomer such as a diisocyanate suspended in an aqueous medium, followed by addition of a second monomer such as a diamine to enable formation of the polymeric shell by interfacial polymerization; and a final core resin formation step by free radical polymerization. In another embodiment, the present invention is directed to a MICR imaging process comprised of sorting security documents prepared utilizing a magnetic MICR toner comprised of resin particles and magnetite, such as MAPICO BLACK TM, and a magnetic encapsulated toner, and wherein the images or characters developed are undetectable by known MICR devices, such as the IBM 890 TM sorter reader or NCR 6780 TM.

In some reprographic technologies, such as xerographic or ionographic single component development systems, the fixing of toner on paper is accomplished by a high pressure fixing device utilizing minimal or no heat. More specifically, the Xerox 4068 printer and Delphax printer utilize fixing pressure of from about 2,000 pounds per square inch to about 4,000 pounds per square inch. In such systems, the conventional toner utilized is comprised of a magnetite, pigment, conductive or charge control agents, and resin, such as polyethylene wax, with a melting point of about 50° to about 90° C. The high pressures exerted by the rolls onto the toner on the paper substrate result in moderate fixing level, such as from about 45 percent to about 60 percent, as measured by the tape fixing method evaluated by the pull method as described in Example 1. In U.S. Pat. No. 5,043,240, a pressure fixable encapsulated toner composition is illustrated wherein a core comprised of a low glass transition temperature resin of from about −70° C., and a shell comprised of a high glass transition temperature of from about 100° to about 200° C. is disclosed. The use of the aforementioned encapsulated toners in high pressure fixing system results in an excellent fixing level, such as from about 75 percent to about 95 percent, as measured by tape fixing method. The mechanism for excellent fixing by utilizing encapsulated toners is believed to be due to the rupture or cracking of the shell component during fixing allowing the core resin to seep out and adhere or stick onto the paper substrate. However, the use of both prior art conventional or encapsulated toner compositions results in high gloss toner images such as from about 50 gloss units to about 70 gloss units as measured by the GARDNER TM gloss meter. The high gloss is believed due to the high pressures exerted by the fixing device resulting in a calendered or smooth toner image. The gloss level is proportional to the smoothness of the toner image after fixing, and can easily be measured using a known GARDNER TM gloss unit. In some reprographic technologies, wherein black or highlight color application is desired, low gloss is desired such as less than 25 gloss units, and more preferably less than 15 gloss units as measured by the GARDNER TM gloss unit. Gloss values of from about 14 gloss units and below are usually known as "matte finish". However, many of the prior art encapsulated magnetic toners do not, it is believed, exhibit low gloss values, and are inferior to black and highlight color reprographic technologies which utilizes high or "cold" pressure fixing devices. The encapsulated toner compositions of the present invention alleviate the problem of high gloss and provide low gloss black and highlight colored images, and more preferably of a matte finish when transfixed using, for example, cold pressure fusers. More specifically, the encapsulated toners of this invention in embodiments utilize a magnetite of large particle size, such as from about 2 microns to about 6 microns, and a light scattering component primarily to further alleviate high gloss such as calcium carbonate, zinc stearate, titanium dioxide and the like of particle size from about 2 to about 6 microns in diameter. Accordingly, when the encapsulated toners of this invention are fixed by cold pressure devices, the toner surface is not smooth and rendered bumpy due to the large particle size of the magnetite, and light scattering of the surface results with the aid of the light scattering component, resulting in low gloss of less than about 20 gloss units and preferably less than about 15 gloss units. Furthermore, the black or colored encapsulated toners of this invention can be of a fine average particle size of from about 11 microns to about 21 microns, and more preferably from about 13 microns to about 17 microns in diameter, unattainable economically by conventional pulverization process. Additionally, the encapsulated toner compositions of the present invention in embodiments display excellent fixing characteristics, such as from about 75 percent to about 95 percent fix, as measured by the tape fixing method.

In some reprographic technologies, especially in security document processing such as checks, including for example dividend checks, turn around documents such as invoice statements like those submitted to customers by American Express and Visa, corporate checks, highway tickets, rebate checks and other documents with magnetic codes thereon, two reprographic systems are utilized. In one reprographic system, such as two component xerographic development systems or ink jet printers, a nonmagnetic toner is fixed onto paper. The aforementioned document is then subjected to a single component reprographic system, such as ionography, which fixes the magnetic toner onto paper. The resulting documents contain both a magnetic and nonmagnetic toner image and wherein only the magnetic image can be detected utilizing a MICR device such as the IBM 890 TM or NCR 6780 TM for sorting and security applications. However, in such process two reprographic technologies must be utilized, and as there is a need wherein the process is simplified by the use of a single reprographic system. The encapsulated toners of this invention in embodiments comprise a magnetic material, wherein the remanence is low and is of from about 0.1 to about 5 gauss, due to the large particle size and selection of magnetite which cannot be detected utilizing a MICR device such as the IBM 890 TM or NCR 6780 TM. Accordingly, the low remanence encapsulated toners of this invention can be imaged by single component development such as ionography, and is not magnetically read or detected by MICR devices. This allows the use of only one reprographic technology, such as a single component development ionographic system, comprised of two development housing and wherein the first development housing contains a magnetic toner which can be detected by MICR devices, and the second development house contains the encapsulated toner of this invention which cannot be detected by MICR devices. Security or sorting documents can be generated by the use of one reprographic system containing two magnetic toners of which only one magnetic toner is detected by the MICR devices. Additionally, three or more development houses in a reprographic device can be devised, wherein colored and black magnetic toners of the present invention can be utilized wherein one or more are selected as magnetically readable and one or more as magnetically nonreadable by MICR devices.

Encapsulated and MICR toners comprised of a core of a polymer and pigment like magnetite and thereover a shell are known. Disclosed in U.S. Pat. No. 4,517,268 are xerographic toners for MICR printing; U.S. Pat. No. 4,268,598 discloses a magnetic toner for the printing of machine legends; also known are magnetic encapsulated toners wherein there are selected magnetic materials, such as BAYFERROX TM or MAPICO BLACK ® magnetites; and U.S. Pat. Nos. 3,627,682; 4,439,510; 4,536,462 and 4,581,312, the disclosures of each of the aforementioned patents being totally incorporated herein by reference. The magnetic toners of the aforementioned prior art patents comprise magnetites of a diameter in the range of from 0.2 to 0.5 micron, and of high remanence, such as from about 10 to about 20 gauss, useful for magnetically detectable images with reader sorters, such as the IBM 3890 TM sorter reader. However, these toners are not effectively suitable for images nondetectable by sorter or reader devices. Additionally, in many instances these toners possess high gloss, as indicated herein, and a smooth developed copy finish rather than a matte or bumpy finish as is the situation with the toners of the present invention. Moreover, in U.S. Pat. No. 4,609,607 there is disclosed a magnetic toner composition and process thereof, note for example column 3, lines 64 to line 67, wherein the magnetic material has a specific area of 10 $m^2$/gram or less and a specific surface area of diameter of 0.1 to 2 microns. Additionally, in column 8, Example 1, through column 12, Example 12, there is disclosed a magnetite, such as EPT-1000, which has a specific surface area diameter of 0.4 micron, and the use of other magnetites of 0.2 to 1.65 microns in specific surface area diameter. Additionally, note column 12, claim 1 (a) wherein the magnetic material is of 0.1 to 2 microns in diameter. These toners do not exhibit, it is believed, low gloss when utilized in ionographic technology, such as illustrated in Comparative Example II that follows, wherein EPT-1000 ® magnetite (produced by Dowa Iron Powder Company)is utilized. Additionally, low remanence is not obtained, it is believed, with the use of the magnetic materials, such as EPT-1000 ® of the aforementioned '607 patent. Similarly, EPT-1000 ® magnetites are disclosed in U.S. Pat. Nos. 4,520,091; 4,576,890; 4,599,289; 4,601,968; 4,610,945; 4,642,281; 4,784,930; 4,803,144 and U.K. Patent Publications 2,137,636A and 2,135,469A. The encapsulated toners of this invention comprise large particle sizes of both magnetites and light scattering components of from about 2 microns to about 6 microns in diameter to achieve bumpy image surfaces resulting in low gloss. Additionally, low remanence is obtained with the use of larger particle size magnetites of from about 2 to about 6 microns in diameter.

In U.S. Pat. No. 4,379,825, there is disclosed a porous electrographic toner, and in column 6, Example 1, through Example 13 of column 15, magnetic materials such as iron oxides of average particle size of from 0.2 to about 2 microns are utilized. In U.S. Pat. No. 4,307,169, there is disclosed a microcapsule magnetic toner, and in column 5, Example 1, through column 11, Example 24, granular and acicular magnetites of particle size of 0.2 to 0.4 are illustrated. In U.K. Patent 1,431,699, there is disclosed a pressure fixable magnetic toner, and particularly note column 8, line 106, wherein the magnetic or magnetizable components should be finely divided, preferably submicron, and note column 8, line 112, wherein the particle sizes are of between 0.1 and 1 micron. Moreover, it is known in the art that by "fine powder" it is meant that the particles are submicron and preferably less than 1 micron. For instance, U.S. Pat. No. 4,795,698, discloses magnetic toners, and in column 12, lines 12 to 15, fine powdery magnetites are utilized of from 0.1 to 1 micron in diameter, and similarly U.S. Pat. No. 4,497,885, column 3, line 32, discloses the use of magnetites of fine powder. Moreover, U.S. Pat. No. 4,499,168, discloses magnetic encapsulated toner, and note column 7, line 1 to line 10, wherein magnetic materials of less than 2 microns are utilized. Pressure fixable encapsulated magnetic toners are disclosed in U.S. Pat. No. 4,708,924, note column 15, line 58, through column 16, line 5, wherein magnetites with average particle sizes of 0.1 to 1 micron are utilized such as in column 16, line 40, of Example 1, wherein iron oxide BL-100® produced by Titanium Kogyo Company is utilized. Other magnetic iron oxide materials such as MAPICO BLACK® produced by Columbian Chemicals, NP604® and NP604® (Northern Pigments), MO8029® and MO8060® (Mobay), CB4799®, CB5300®, CB5600®, MCX636® (Pfizer), TMB-100® or TMB-104® (Magnox) are of fine powdery size of 0.1 to about 1 micron in diameter, such as disclosed in U.S. Pat. Nos. 5,043,240; 5,045,428; 5,080,986; 5,045,422; and European Patent 276147 A. The aforementioned prior art does not, it is believed, utilize a large particle size magnetite of about 2 to about 6 microns, light scattering components of from about 2 microns to about 6 microns in diameter, such as used in the present invention, and is necessary to achieve bumpy image surfaces resulting in low gloss. Additionally, low remanence is obtained with the use of large particle size magnetites, such as in the present invention, of from about 2 to about 6 microns in diameter, and which toners can be selected for security document applications, wherein part of the document is imaged by a low remanence toner, is not detected by MICR devices such as the IBM 890 TM or NCR 6780 TM reader sorters.

There is disclosed in U.S. Pat. No. 4,797,344 a magnetic toner with inorganic materials such as alumina, titanium dioxide and like, see column 4, lines 33 to 36, wherein these inorganic materials are on the toner surface and attached by blending, and note column 5, line 3 to line 15, wherein the function of the inorganic material is used to increase the mechanical strength of the toner. Moreover, in the aforementioned '344 patent, note column 4, lines 37 to 69, wherein the inorganic materials are of fine particle size and of specific surface area of 50 to 400 $m^2$/gram (less than 1 micron in diameter). Also, U.S. Pat. No. 4,824,754, discloses magnetic toners with metal oxides on the toner surface as flowability and electric charging purpose, and note column 5, lines 55 to 57, wherein the diameter of the metal oxide is of not larger than 1 micron, and note claim 4 wherein said particles of metallic oxide may comprise primary particles having a mean size of not more than 1 micron. Similarly, U.S. Pat. No. 4,965,162, discloses magnetic toners wherein tin oxide is utilized on the toner surface for increasing the toner's conductivity, and note column 2, lines 59 to 64, wherein the tin oxide preferably has an average size of not more than 0.3 micron.

Disclosed in U.S. Pat. No. 5,223,370 are toners with a core comprised of a polymer resin, colorants, such as pigment or dye, and thereover an inner shell comprised of a polyurea, a polyurethane, a polyether, a polyamide, or a polyester, and thereover an outer shell coating comprised of a cellulose polymer, such as methyl cellulose, a mixture of methyl cellulose and methyl ethyl cellulose, available as TYLOSE® from Fluka Biochemical Company, and the like. The aforementioned inner and outer shells are believed to yield low gloss or matte finish prints of from about one gloss unit to about 14 gloss units, especially when reprographic technologies employing VITON® fusers are utilized. However these toners are not, it is believed, magnetic and cannot be effectively utilized in reprographic technologies, such as ionography, wherein cold pressure fixing devices are employed. Additionally, in the patent there is selected an inner and outer shell to alleviate gloss. The toners of this invention utilize large particle size and low remanence magnetites as well as deglosser to alleviate gloss in cold pressure fixing devices with little or no heat.

Many of the prior art encapsulated toner compositions, particularly colored toner compositions, suffer from a number of deficiencies as indicated herein. For example, these toners do not possess, it is believed, desirable low gloss of from less than about 25 gloss units and more preferably less than 15 gloss units or a matte finish in reprography utilizing cold pressure fixing devices. Further, many of the prior art encapsulated toners do not display fusing properties such as being able to be fused at a reasonably low temperature of, for example, less than 60° C. Also, many of the prior art encapsulated toners are not magnetic and cannot be utilized in reprographic single component technology, such as ionography. Also, low fixing properties, such as less than 70 percent fix level as measured by the tape fix method, are obtained with several of the prior art conventional toners. These and other disadvantages are eliminated or substantially eliminated with the processes and toner compositions of the present invention.

There is a need for toners which display low gloss values and are preferably of a matte finish, especially with black or highlight color reprographic systems employing cold pressure fixing device. Additionally, there is a need for color toners with low minimum fusing temperatures, wide fusing latitude, of fine particle size, of nonblocking tendencies, and of low remanence. These and other needs are accomplished with the encapsulated toners and processes thereof of the present invention. Specifically, with the toners of the present invention in embodiments, low gloss images of matte finish are attainable with reprographic technologies employing cold pressure fixing devices. Also, in embodiments the magnetic toners of this invention are of low remanence and cannot be detected by MICR devices. Also, the toners of the present invention possess excellent fixing properties, and do not block or agglomerate over an extended period of time, for example up to six months, in embodiments.

SUMMARY OF THE INVENTION

It is an object of the present invention to provide toner compositions with many of the advantages illustrated herein.

It is also an object of the present invention to provide encapsulated toner compositions, including black, with desirable low gloss and matte finish prints.

It is another object of the present invention to provide encapsulated toner compositions, including black, that enable developed images with desirable low remanence.

Additionally, it is another object of the present invention to provide in embodiments encapsulated toners with desirable properties as excellent toner powder flow, nonblocking characteristics, and excellent image permanence characteristics.

An additional object of the present invention is the provision of encapsulated toner compositions with low gloss properties that are predominantly controlled by the use of a light scattering component, and/or the selection of a magnetite core component with a large particle size of, for example, in the range of 2 to about 10 microns and preferably from about 2 micron to about 6 microns.

Moreover, another object of the present invention is the provision of encapsulated toner compositions whose low remanence properties are predominantly controlled by the use of a magnetite with a large particle size of, for example, in the range of 2 to about 10 microns and preferably from about 2 micron to about 6 microns.

The present invention in embodiments is directed to the provision of toners, and more specifically, encapsulated toners with a core of magnetite with a large diameter size, and a light scattering component. In embodiments of the present invention, there are provided encapsulated toners with a core comprised of a polymer resin, colorants, such as pigment or dye, especially magnetite, and thereover a shell comprised of a polyurea, a polyurethane, a polyether, a polyamide, or a polyester. The aforementioned toners in embodiments yield low gloss or matte finish prints of from about one gloss unit to about 15 gloss units, especially with reprographic technologies employing cold pressure fixing devices. The toner compositions of the present invention in embodiments are comprised of a core containing a polymer resin, magnetite particles with an average diameter of from between about 2 to about 6 microns, a light scattering component, and thereover a known polymeric shell, such as a shell comprised of a condensation polymer, such as a polyurea, with an effective thickness of, for example, from between about 0.1 to 5 microns as measured by Tunnelling Electron Microscopy (TEM).

Of importance with respect to the encapsulated toners of the present invention in embodiment is the utilization of a light scattering component with a particle size volume average diameter of from about 2 microns to about 6 microns and a magnetic material with a particle size of from about 2 microns to about 6 microns. It is believed that either or, preferably both, the magnetite and deglosser be of a particle size of from about 2 microns to about 6 microns, such that low gloss toner image are obtained when fixed by a cold pressure fixing device. With the use of smaller magnetic material, such as from about 0.1 to about 1 micron, high gloss can be obtained, such as from about 50 gloss units to about 75 gloss units, as illustrated in Comparative Examples I and II. In cold pressure fixing process, the encapsulated toner is ruptured during fixing and allows the core resin to diffuse or seep into the paper fibers and adhere the toner onto paper. If small particle size composite material, such as from about 0.1 to about 0.5 micron, of magnetite or light scattering component is utilized, the high pressures of the fixing device penetrates the composite components into the paper fibers resulting in calendering, resulting in a flattened or smooth image toner surface. Smooth surfaces yield high gloss such as from about 50 to about 70 gloss units. When larger particle size composite materials, such as from about 2 to about 6 microns, of magnetite or light scattering component are utilized, the high pressures of the fixing device do not substantially penetrate the aforementioned magnetic particles into the paper fibers, and a bumpy or uneven toner image surface results, hence low gloss of from about 1 gloss unit to about 15 gloss units.

The toner compositions of the present invention can be prepared by a number of methods including a simple one-pot process involving formation of stabilized particle suspension, followed by an interfacial inner shell polymerization, and by a core resin forming free radical polymerization within the particles. The process is comprised of, for example, (1) thoroughly mixing or blending a mixture of core resin monomers, optional preformed core resins, free radical initiators, magnetite of a particle size diameter in the range of 2 to about 6 microns, a light scattering component of a particle size diameter in the range of 2 to about 6 microns, and an inner shell forming monomer such as a diisocyanate (ISONATE 143 TM); (2) dispersing the aforementioned well blended mixture by high shear blending to form stabilized microdroplets of specific droplet size and size distribution in an aqueous medium containing a surfactant such as polyvinyl alcohol, and wherein the volume average microdroplet diameter can be desirably adjusted to be from about 11 microns to about 21 microns with the volume average droplet size dispersity being less than 1.35 by adjusting the concentration of polyvinyl alcohol; (3) adding shell forming monomer, such as a diamine (DYTEK A TM), which condenses with the diisocyanate shell forming monomer via an interfacial polymerization mechanism resulting in a polyurea shell material; (4) effecting the free radical polymerization to form the core resin by heating; and (5) processing the resulting particles by washing, drying and treating with known surface additives. The formation of stabilized particle suspension is generally conducted at ambient, about 25° C. in embodiments, temperature, while the free radical polymerization can be accomplished at a temperature of from about 35° C. to about 120° C., and preferably from about 45° C. to about 90° C., for a period of time of from about 1 to about 24 hours depending primarily on the monomers and free radical initiators used. The core resin obtained via free radical polymerization, together with the optional preformed polymer resin, comprises from about 16 to about 40 percent, and preferably of from about 20 to about 30 percent by weight of the toner, the magnetite comprises from about 20 to about 65 percent by weight of the toner, the light scattering component comprises from about 16 to about 40 percent, and preferably of from about 10 to about 30 percent by weight of toner, and the shell comprises from about 5 to about 30 percent by weight and more preferably from about 10 to about 20 percent by weight of the toner, while the surface additives like flow aids, surface release agents, and charge control chemicals can comprise from about 0.1 to about 5 percent of the toner in embodiments thereof.

The volume average particle size of the magnetite encapsulated toners of this invention in embodiments can be controlled by, for example, appropriately adjusting the concentration of the components. For example, in embodiments, the size of the encapsulated toner can be controlled such that the volume average toner particle size is 17 microns in diameter by utilizing from about 0.1 to about 0.12 percent of polyvinyl alcohol by weight of water. In another embodiment, the volume average particle size of the encapsulated toner can be controlled to about 15 microns in diameter by utilizing from about 0.13 to about 0.15 percent of polyvinyl alcohol by weight of water. In another embodiment, the volume average particle size of the colored encapsulated toner can be controlled to about 13 microns in diameter by utilizing from about 0.16 to about 0.18 percent of polyvinyl alcohol by weight of water.

Illustrative examples of core monomers, present in effective amounts, which are subsequently polymerized, include a number of known components such as acrylates, methacrylates, olefins including styrene and its derivatives such as methyl styrene, and the like. Specific examples of core monomers include methyl acrylate, methyl methacrylate, ethyl acrylate, ethyl methacrylate, propyl acrylate, propyl methacrylate, butyl acrylate, butyl methacrylate, pentyl acrylate, pentyl methacrylate, hexyl acrylate, hexyl methacrylate, heptyl acrylate, heptyl methacrylate, octyl acrylate, octyl methacrylate, cyclohexyl acrylate, cyclohexyl methacrylate, lauryl acrylate, lauryl methacrylate, stearyl acrylate, stearyl methacrylate, benzyl acrylate, benzyl methacrylate, ethoxypropyl acrylate, ethoxypropyl methacrylate, methylbutyl acrylate, methylbutyl methacrylate, ethylhexyl acrylate, ethylhexyl methacrylate, methoxybutyl acrylate, methoxybutyl methacrylate, cyanobutyl acrylate, cyanobutyl methacrylate, tolyl acrylate, tolyl methacrylate, styrene, substituted styrenes, other substantially equivalent addition monomers, and known addition monomers, reference for example U.S. Pat. No. 4,298,672, the disclosure of which is totally incorporated herein by reference, and mixtures thereof. Illustrative examples of optional preformed core resins include styrene polymers, such as styrene-butadiene copolymers, PLIOLITES ®, PLIOTONES ®, polyesters, acrylate and methacrylate polymers, and the like.

Various known magnetites with magnetic saturations of from about 60 to about 100 emu per gram, necessary for single component reprography, and low remanence of from about zero to about 10 gauss for nonmagnetic readable toners, can be selected from, for example, ferromagnetic materials, such as COBALT TM (available from Noah), with particle sizes greater than about 2 microns and preferably greater than about 4 microns, iron powder (available from BASF) with particle sizes greater than about 2 microns and preferably from about 2 microns to about 6 microns, iron oxide, such as Toda Kogyo KNS-415 ®, with particle sizes ranging from about 2 to about 8 microns, iron oxide (available from Northern Pigment)with particle sizes ranging from about 2 micron to about 8 microns, and Magnavox's iron oxide with average particle size of about 5.5 microns. The magnetite is present in various effective amounts, such as for example from about 35 percent to about 60 percent by weight.

Light scattering component examples include titanium oxide, calcium carbonate, zinc oxide, magnesium oxide, zinc stearate, magnesium stearate, alumina, barium titanate, calcium titanate, strontium titanate, siliceous sand, mica, wollastonite, diamaceous earth, chromium oxide, cerium oxide, zirconium oxite, tin oxide, barium sulfate, barium carbonate, calcium sulfate, silicone carbide, silicon nitride, antimony trioxide, sodium sulfate, potassium sulfate, mixtures thereof and the like. In an embodiment, the light scattering component has an average particle size in the range of over 0.5 micron, and preferably from about 2 to about 6 microns. The light scattering component is present in various effective amounts, such as for example from about 5 percent to about 25 percent by weight.

Surfactant examples include alkali salts, such as potassium oleate, potassium caprate, potassium stearate, sodium laurate, sodium dodecyl sulfate, sodium oleate, sodium laurate, and the like; silicas such as AEROSIL R972 ®; celluloses such as methyl cellulose, methylethyl cellulose, hydroxyethyl cellulose, hydroxymethyl cellulose, polyvinyl alcohol, polyethylene glycol, polyacrylic acid, poly nonylphenyl ether, mixtures thereof and the like, which are present in various effective amounts, such as for example from about 0.01 percent to about 2 percent by weight.

Examples of preferred shell polymers include polyureas, polyamides, polyethers, polyesters, polyurethanes, mixtures thereof, and the like, which shells may contain within their structures certain soft, flexible moieties such as polyether functions which, for example, assist in the molecular packing of the shell materials as well as imparting the desirable low surface energy characteristics to the shell structure. The shell amounts are generally from about 5 to about 30 percent by weight of the toner, and have a thickness generally, for example, of less than about 5 microns as indicated herein. In embodiments of the present invention, the encapsulant shells are formed by interfacial polycondensation of one or more diisocyanates with one or more diamines. Examples of diisocyanates include Uniroyal Chemical's diphenylmethane diisocyanate-based liquid polyether VIBRATHANES ® such as B-635, B-843, and the like, toluene diisocyanate-based liquid polyether VIBRATHANES ® such as B-604, B-614, and the like, and Mobay's Chemical Corporation's liquid polyether isocyanate prepolymers, E-21 TM or E-21A TM (product code number D-716), 743 (product code numbers D-301), 744 (product code number D-302), and the like. Other diisocyanates that can be selected for the formation of shell material are those available commercially including, for example, benzene diisocyanate, toluene diisocyanate, diphenylmethane diisocyanate, 1,6-hexamethylene diisocyanate, DESMODUR W TM, bis(4-isocyanatocyclohexyl)methane, MONDUR CB-60 TM, MONDUR CB-75 TM, MONDUR MR TM, MONDUR MRS 10 TM, PAPI 27 TM, PAPI 135 TM, ISONATE 143L TM, ISONATE 181 TM, ISONATE 125M TM, ISONATE 191 TM, and ISONATE 240 TM. Illustrative examples of diamines suitable for the interfacial polycondensation shell formation include, for example, ethylenediamine, tetramethylenediamine, pentamethylenediamine, hexamethylenediamine, p-phenylenediamine, m-phenylenediamine, 2-hydroxy trimethylenediamine, diethylenetriamine, triethylenetetraamine, tetraethylenepentaamine, 1,8-diaminooctane, xylylenediamine, bis(hexamethylene)-triamine, tris(2-aminoethyl)amine, 4,4'-methylene bis(-cyclohexylamine), bis(3-aminopropyl)ethylenediamine, 1,3-bis(aminomethyl)cyclohexane, 1,5-diamino-2-methylpentane, piperazine, 2-methylpiperazine, 2,5-dimethylpiperazine, 1,4-bis(3-aminopropyl)-piperazine, and 2,5-dimethylpentamethylenediamine. Generally, the shell polymer comprises from about 5 to about 30 percent by weight of the total toner composition, and preferably comprises from about 10 percent by weight to about 20 percent by weight of the toner composition. During the aforementioned interfacial polycondensation to form the shell, the temperature is maintained at from about 15° C. to about 55° C., and preferably from about 20° C. to about 30° C. Also, generally the reaction time is from about 5 minutes to about 5 hours, and preferably from about 20 minutes to about 90 minutes. Other temperatures and times can be selected, and further polyisocyanates and polyamines not specifically illustrated may be selected in embodiments.

Illustrative examples of known free radical initiators that can be selected for the preparation of the toners include azo-type initiators such as 2-2'-azobis-(dimethylvaleronitrile), azobis-(isobutyronitrile), azobis-(cyclohexane-nitrile), azobis-(methylbutyronitrile), mixtures thereof, and the like; peroxide initiators such as benzoyl peroxide, lauroyl peroxide, methyl ethyl ketone peroxide, isopropyl peroxycarbonate, 2,5-dimethyl-2,5-bis-(2-ethylhexanoylperoxy)hexane, di-tert-butyl peroxide, cumene hydroperoxide, dichlorobenzoyl peroxide, and mixtures thereof, with the effective quantity of initiator being, for example, from about 0.1 percent to about 10 percent by weight of that of core monomer.

In embodiments of the present invention, the encapsulated magnetic toner is prepared, for example, by (1)thoroughly mixing or blending a mixture of core resin monomer such as n-lauryl methacrylate of from about 24 to about 26 percent by weight of toner, a free radical initiator such as azobis-(isobutyronitrile) of from about 0.01 to 0.03 percent by weight of toner, a magnetite of a particle size diameter in the range of 2 to about 6 microns such as iron powder (obtained from BASF) of from about 38 to about 42 percent by weight of the toner, a light scattering component such as titanium oxide of a particle size diameter in the range of 2 to about 4 microns of from about 20 to about 28 percent by weight of toner, a pigment such as carbon black (available as REGAL 330®) of from about 4 to about 7 percent by weight, and an inner shell forming monomer such as ISONATE 143 TM (available from Mobay) of from about 10 to about 13 percent by weight of toner; (2) dispersing the aforementioned well blended mixture by high shear blending at from about 10,000 revolution per minute in an aqueous solution containing of about 0.10 percent by weight of a surfactant such as polyvinyl alcohol, and wherein the volume average microdroplet diameter is from about 16 microns to about 17 microns with the volume average droplet size dispersity being less than 1.35; (3) adding the shell forming monomer such as a 2-pentamethyldiamine (available from Dupont as DYTEK A TM ) of from about 10 to about 13 percent by weight resulting in a polyurea shell material; (4) effecting free radical polymerization to form the core resin by heating of from about 75° to about 90° C. for a duration of from about 3 hours to about 6 hours; and (5) further processing the resulting particles by washing, drying and treating with known surface additives, flow aids, about 0.1 to about 5 percent of the toner in embodiments thereof.

Embodiments of the present invention include a toner composition comprised of a core comprised of a polymer resin or resins, low remanence magnetite of from between about 0.1 to about 8 gauss with an average volume particle diameter of from between about 2 to about 6 microns, and a light scattering component with an average particle diameter of from between about 2 to about 6 microns; and which core is encapsulated in a polymeric shell; a process for the preparation of toner compositions which comprises dispersing a mixture of addition monomers, an optional preformed polymer resin, free radical initiator, magnetite with an average particle diameter in the range of about 2 to about 6 microns, a deglosser light scattering component and a shell forming monomer to form a stable microdroplet suspension in an aqueous medium containing an optional ionic or inorganic surfactant; subsequently adding an aqueous soluble monomer thereby forming the shell wall by interfacial polymerization; and thereafter initiating core resin-forming free radical polymerization by heating, and subsequently separation of the toner by washing, centrifugation and drying; an imaging process which comprises the generation of an image on an imaging surface, subsequently developing this image with the toner composition, thereafter transferring the image to a suitable substrate, and permanently affixing the image thereto and wherein there results matte images, and wherein the gloss level of the fixed toner image is from about 1 gloss unit to about 15 gloss units; and a process for the preparation of security documents comprised of images developed with the magnetic toner, and images developed with a nonencapsulated magnetic toner comprised of resin and magnetite particles.

The following Examples are being submitted to further define various species of the present invention. These Examples are intended to be illustrative only and are not intended to limit the scope of the present invention. Comparative Examples are also provided.

Comparative Example I

A 18.8 micron magnetic encapsulated toner comprised of a core comprised of poly(n-lauryl methacrylate), Bayer 8610 magnetite and a shell comprised of a polyurethane as described in Example 1 of U.S. Pat. No. 5,043,240 was prepared as follows.

A mixture of n-lauryl methacrylate (113 grams), 2,2'-azo-bis-(2,4-dimethyl-valeronitrile) (3.3 grams), 2,2'-azo-bis-(isobutyronitrile) (3.3 grams), ISONATE 143L TM (42.2 grams) and Bayer's polyether isocyanate prepolymer E-21A (5.7 grams) was homogenized in a 2 liter Nalgene container with a Brinkmann polytron at 4,000 RPM for 30 seconds. To this mixture were then added the magnetite BAYFERROX 8610 TM (300 grams) of particle size volume diameter throughout, unless otherwise indicated, of about 0.1 to about 0.5 micron and remanence of about 18 gauss and dichloromethane (20 milliliters), and the corresponding slurry was homogenized at 8,000 RPM for three minutes. To the resulting mixture was added 1 liter, 0.10 percent (by weight), of an aqueous solution, and thereafter, the mixture was homogenized again at 9,000 RPM for two minutes. The resulting dispersion was transferred to a 2 liter kettle equipped with a mechanical stirrer and immersed in an oil bath. To the kettle contents was then added a solution of 37 milliliters of 1,4-bis(3-aminopropyl)piperazine in 80 milliliters of water, and the resulting mixture was allowed to react for one hour. Thereafter, the kettle was heated to 85° C. over a period of one hour, and the polymerization was continued at this temperature for 6 hours before cooling down to room temperature. The resulting mixture was then transferred to a 4 liter beaker, and diluted with water to a volume of about four liters with constant stirring. The encapsulated toner was allowed to settle to the bottom of the beaker by gravity, and the aqueous supernatant was carefully decanted. The washing was repeated in this manner three times until the washing was clear. The washed toner was transferred to a 2 liter beaker and diluted with water to a total of 1.8 liter. AQUADAQ GRAPHITE E TM (23.5 grams, from Acheson Colloids), and water(100 milliliters) were then added, and the mixture was spray dried in a Yamato Spray Dryer at an air inlet temperature of 160° C., and an outlet temperature of 80° C. The airflow was retained at 1.0 kilogram/cm$^2$. The collected dry encapsulated toner (360 grams) was screened through a 63 micron screen; the toner volume average particle diameter, as measured on a 256 channel Coulter Counter, was 18.8 microns with a volume average particle size dispersity of 1.36.

Two hundred and forty grams of the above encapsulated toner were dry blended using a Grey blender, first with 0.96 gram of carbon black (BLACK PEARL 2000 TM ) for two minutes at 3,500 RPM, and then with 3.6 grams of zinc stearate for an additional 10 minutes at 3,000 RPM to provide the toner with a volume resistivity of $1\times10^6$ ohm-cm.

The pressure fixing ionographic printer elected for the testing of this toner was the Xerox Corporation 4060 printer. The developed images were transfixed at a pressure of 2,000 psi. Print quality was evaluated from a checkerboard print pattern. The image optical density was measured using a standard integrated densitometer. Image fix was measured by the standardized tape pull method wherein a tape was pressed with a uniform reproducible standard pressure against the image and then removed. The imaged fix level is expressed as a percentage of the retained image optical density after the tape test, relative to the original image optical density. For the encapsulated toner of this Comparative Example I, the image fix level was 92 percent.

The gloss level was measured on a 1 square inch toner image after fixing by utilizing a Gloss Gardner meter. The gloss level for the encapsulated toner of this Comparative Example I was 56 gloss units. Additionally, the remanence of this toner was measured to be 19 gauss units. MICR characters were generated using an E-13 B font (the standard used by the MICR industry as set by ANSI (American National Standard Institute), and were printed on the aforementioned Xerox 4060 printer. The magnetic strength was tested using the MICR-MATE 1 magnetic signal tester from Checkmate Electronics. The average magnetic signal strength (as a percentage of he nominal strength) for the MICR characters was used for the evaluation. The specifications for MICR magnetic strength is set by ANSI. The acceptable range is 50 to 200 percent of the nominal in the United States, and 80 to 200 percent of the nominal in Canada. It is preferred to print checks with an average signal level of about 100 percent or slightly larger for MICR uses. For nonmagnetic character readings, a signal level of below 30 percent, and more preferably around 0 percent is usually needed. For the encapsulated toner of this Comparative Example I, the MICR signal was 60 percent, thus this toner is not acceptable, by ANSI standard, for use in a nonmagnetic character reading process.

Comparative Example II

A 19 micron low gloss and low remanence magnetic encapsulated toner comprised of a core comprised of poly(n-lauryl methacrylate), iron oxide magnetite (EPT-1000®) and a shell comprised of a polyurethane was prepared as follows.

A mixture of n-lauryl methacrylate (113 grams), 2,2'-azo-bis-(2,4-dimethyl-valeronitrile) (3.3 grams), 2,2'-azo-bis-(isobutyronitrile)(3.3 grams), ISONATE 143L TM (47.6 grams), and iron oxide EPT-1000® (of average particle volume diameter of 0.25 micron, available from Dowa Iron Powder Company) (300 grams) was homogenized in a 2 liter Nalgene container with a Brinkmann polytron at 4,000 RPM for 30 seconds. To the resulting mixture was added 1 liter, 0.10 percent (by weight), of an aqueous water solution, and thereafter, the mixture was homogenized again at 9,000 RPM for two minutes. The resulting dispersion was transferred to a 2 liter kettle equipped with a mechanical stirrer and immersed in an oil bath. To the kettle contents were then added a solution of 37 milliliters of 2-pentamethylene diamine (DYTEK A TM obtained from DuPont) in 80 milliliters of water, and the resulting mixture was allowed to react for one hour. Thereafter, the kettle was heated to 85° C. over a period of one hour, and the polymerization was continued at this temperature for 6 hours before cooling down to room temperature, 25° C. The resulting mixture was then transferred to a 4 liter beaker, and diluted with water to a volume of about four liters with constant stirring. The encapsulated toner was allowed to settle to the bottom of the beaker by gravity, and the aqueous supernatant was carefully decanted. The washing was repeated in this manner three times until the washing was clear. The washed toner was transferred to a 2 liter beaker and diluted with water to a total of 1.8 liter. AQUADAQ GRAPHITE E TM (23.5 grams, from Acheson Colloids), and water (100 milliliters) were then added, and the mixture was spray dried in a Yamato Spray Dryer at an air inlet temperature of 160° C., and an outlet temperature of 80° C. The airflow was retained at 1.0 kilogram/$cm_2$. The collected dry encapsulated toner (380 grams) was screened through a 63 micron screen; the toner volume average particle diameter, as measured on a 256 channel Coulter Counter, was 19 microns with a volume average particle size dispersity of 1.45.

Two hundred and forty grams of the above encapsulated toner were dry blended using a Grey blender, first with 0.96 gram of carbon black (BLACK PEARL 2000 TM ) for two minutes at 3,500 RPM, and then with 3.6 grams of zinc stearate for an additional 10 minutes at 3,000 RPM, to provide the toner with a volume resistivity of $1.4\times10^6$ ohm-cm.

The pressure fixing ionographic printer elected for the testing of this toner was the Xerox Corporation 4060 printer. The developed images were transfixed at a pressure of 2,000 psi. Print quality was evaluated from a checkerboard print pattern. The image optical density was measured using a standard integrated densitometer. Image fix was measured by the standardized tape pull method wherein a tape was pressed with a uniform reproducible standard pressure against an image and then removed. The imaged fix level is expressed as a percentage of the retained image optical density after the tape test, relative to the original image optical density. For the encapsulated toner of this Comparative Example II, the image fix level was 90 percent.

The gloss level was measured on a 1 square inch toner image after fixing by utilizing a Gloss Gardner meter. The gloss level for the encapsulated toner of this Comparative Example II was 58 gloss units. Additionally, the remanence of this toner was measured to be 19 gauss units. MICR characters were then generated using an E-13 B font (the standard used by the MICR industry in the United States as set by ANSI (American National Standard Institute), and were printed on the aforementioned Xerox Corporation 4060 printer. The magnetic strength for MICR was tested using the MICR-MATE 1 magnetic signal tester from Checkmate Electronics. The average magnetic signal strength (as a percentage of the nominal strength) for the MICR characters was used for the evaluation. The specifications for MICR magnetic strength is set by ANSI. The acceptable range is 50 to 200 percent of the nominal in the United States, and 80 to 200 percent of the nominal in Canada. It is preferred to print checks with an average signal level of about 100 percent or slightly larger for MICR uses. For nonmagnetic character readings, a signal level of below 30 percent, and more preferably around 0 percent is necessary. For the encapsulated toner of this Comparative Example II, the MICR signal was 63 percent, thus this toner is not acceptable, by ANSI standards, for use in a nonmagnetic character reading process.

EXAMPLE I

An 18 micron low gloss and low remanence magnetic encapsulated toner comprised of a core comprised of poly(n-lauryl methacrylate), iron oxide magnetite and a shell comprised of a polyurethane was prepared as follows.

A mixture of n-lauryl methacrylate (113 grams), 2,2'-azo-bis-(2,4-dimethyl-valeronitrile) (3.3 grams), 2,2'-azo-bis-(isobutyronitrile) (3.3 grams), ISONATE 143L TM (47.6 grams), iron oxide (average volume diameter particle size of 5.5 microns) (260 grams), and titanium dioxide (40 grams) was homogenized in a 2 liter Nalgene container with a Brinkmann polytron at 4,000 RPM for 30 seconds. To the resulting mixture was added 1 liter, 0.10 percent (by weight), of an aqueous solution, and thereafter, the mixture was homogenized again at 9,000 RPM for two minutes. The resulting dispersion was transferred to a 2 liter kettle immersed in an oil bath, and equipped with a mechanical stirrer. To the kettle contents was then added a solution of 37 milliliters of 2-pentamethylene diamine (DYTEK A TM obtained from DuPont) in 80 milliliters of water, and the resulting mixture was allowed to react for one hour. Thereafter, the kettle was heated to 85° C. over a period of one hour, and the polymerization was continued at this temperature for 6 hours before cooling down to room temperature. The resulting mixture was then transferred to a 4 liter beaker, and diluted with water to a volume of about four liters with constant stirring. The encapsulated toner was allowed to settle to the bottom of the beaker by gravity, and the aqueous supernatant was carefully decanted. The washing was repeated in this manner three times until the washing was clear. The washed toner was transferred to a 2 liter beaker and diluted with water to a total of 1.8 liter. AQUADAQ GRAPHITE E TM (23.5 grams, from Acheson Colloids), and water (100 milliliters) were then added, and the mixture was spray dried in a Yamato Spray Dryer at an air inlet temperature of 160° C., and an outlet temperature of 80° C. The airflow was retained at 1.0 kilogram/cm$^2$. The collected dry encapsulated toner (340 grams) was screened through a 63 micron screen; the toner volume average particle diameter, as measured on a 256 channel Coulter Counter, was 18 microns with a volume average particle size dispersity of 1.35.

Two hundred and forty grams of the above encapsulated toner were dry blended using a Grey blender, first with 0.96 gram of carbon black (BLACK PEARL 2000 TM ) for two minutes at 3,500 RPM, and then with 3.6 grams of zinc stearate for an additional 10 minutes at 3,000 RPM to provide the toner with a volume resistivity of $1.6\times10^6$ ohm-cm.

The pressure fixing ionographic printer elected for the testing of this toner was the Xerox Corporation 4060 printer. The developed images were transfixed at a pressure of 2,000 psi. Print quality was evaluated from a checkerboard print pattern. The image optical density was measured using a standard integrated densitometer. Image fix was measured by the standardized tape pull method wherein a tape was pressed with a uniform reproducible standard pressure against an image and then removed. The imaged fix level is expressed as a percentage of the retained image optical density after the tape test, relative to the original image optical density. For the encapsulated toner of this Example I, the image fix level was 88 percent.

The gloss level was measured on a 1 square inch toner image after fixing by utilizing a Gloss Gardner meter. The gloss level for the encapsulated toner of this Example I was 23 gloss units. Additionally, the remanence of this toner was measured to be 6 gauss units. The toner of this Example has low gloss and low remanence as compared to the Comparative Example I. MICR characters were then generated using an E-13 B font (the standard used by the MICR industry in the United States as set by ANSI (American National Standard Institute), and were printed on the aforementioned Xerox 4060 printer. The magnetic strength for MICR was tested using the MICR-MATE 1 magnetic signal tester from Checkmate Electronics. The average magnetic signal strength (as a percentage of the nominal strength) for the MICR characters was used for the evaluation. The specifications for MICR magnetic strength is set by ANSI. The acceptable range is 50 to 200 percent of the nominal in the United States, and 80 to 200 percent of the nominal in Canada. It is preferred to print checks with an average signal level of about 100 percent or slightly larger for MICR uses. For nonmagnetic character readings, a signal level of below 30 percent, and more preferably around 0 percent is necessary. For the encapsulated toner of this Example I, the MICR signal was 30 percent, thus this toner is acceptable, by ANSI standards, for use in nonmagnetic character reading devices.

EXAMPLE II

A 17 micron low gloss and low remanence magnetic encapsulated toner comprised of a core comprised of poly(n-lauryl methacrylate), iron powder magnetite and a shell comprised of a polyurethane was prepared as follows.

A mixture of n-lauryl methacrylate (113 grams), 2,2'-azo-bis-(2,4-dimethyl-valeronitrile) (3.3 grams), 2,2'-azo-bis-(isobutyronitrile) (3.3 grams), ISONATE 143L TM (47.6 grams), iron powder (average particle size of 4.2 microns) (220 grams), carbon black (REGAL 330®) (3 grams), and titanium dioxide (75 grams)was homogenized in a 2 liter Nalgene container with a Brinkmann polytron at 4,000 RPM for 30 seconds. To the resulting mixture was added 1 liter, 0.10 percent (by weight), of an aqueous solution, and thereafter, the mixture was homogenized again at 9,000 RPM for two minutes. The resulting dispersion was transferred to a 2 liter kettle immersed in an oil bath, and equipped with a mechanical stirrer. To the kettle contents was then added a solution of 37 milliliters of 2-pentamethylene diamine (DYTEK A TM obtained from DuPont) in 80 milliliters of water, and the resulting mixture was allowed to react for one hour. Thereafter, the kettle was heated to 85° C. over a period of one hour, and the polymerization was continued at this temperature for 6 hours before cooling down to room temperature. The resulting mixture was then transferred to a 4 liter beaker, and diluted with water to a volume of about four liters with constant stirring. The encapsulated toner was allowed to settle to the bottom of the beaker by gravity, and the aqueous supernatant was carefully decanted. The washing was repeated in this manner three times until the washing was clear. The washed toner was transferred to a 2 liter beaker and diluted with water to a total of 1.8 liter. AQUADAQ GRAPHITE E TM (23.5 grams, from Acheson Colloids), and water (100 milliliters) were then added, and the mixture was spray dried in a Yamato Spray Dryer at an air inlet temperature of 160° C., and an outlet temperature of 80° C. The airflow was retained at 1.0 kilogram/cm$^2$. The collected dry encapsulated toner (365 grams) was screened through a 63 micron screen; the toner volume average particle diameter, as measured on a 256 channel Coulter Counter, was 17 microns with a volume average particle size dispersity of 1.38.

Two hundred and forty grams of the above encapsulated toner were dry blended using a Grey blender, first with 0.96 gram of carbon black (BLACK PEARL 2000 TM) for two minutes at 3,500 RPM, and then with 3.6 grams of zinc stearate for an additional 10 minutes at 3,000 RPM, to provide for the toner a volume resistivity of $2.5\times10^6$ ohm-cm.

The imaged fix, gloss level, remanence and MICR signal were evaluated as described in Example I, and for the encapsulated toner of this Example II, the image fix level was 85 percent, the gloss level was 13 gloss units, the remanence was 1.4 gauss and the MICR signal was 6 percent.

EXAMPLE III

A 16 micron low gloss and low remanence magnetic encapsulated toner comprised of a core comprised of poly(n-lauryl methacrylate), iron powder magnetite and a shell comprised of a polyurethane was prepared as follows.

A mixture of n-lauryl methacrylate (113 grams), 2,2'-azo-bis-(2,4-dimethyl-valeronitrile) (3.3 grams), 2,2'-azo-bis-(isobutyronitrile) (3.3 grams), ISONATE 143L TM (47.6 grams), iron powder magnetite (average particle size of 4.2 microns) (230 grams), carbon black (REGAL 330®) (3 grams), and titanium dioxide (60 grams) was homogenized in a 2 liter Nalgene container with a Brinkmann polytron at 4,000 RPM for 30 seconds. To the resulting mixture was added 1 liter, 0.10 percent (by weight), of an aqueous solution, and thereafter, the mixture was homogenized again at 9,000 RPM for two minutes. The resulting dispersion was transferred to a 2 liter kettle immersed in an oil bath, and equipped with a mechanical stirrer. To the kettle contents was then added a solution of 37 milliliters of 2-pentamethylene diamine (DYTEK A TM obtained from DuPont) in 80 milliliters of water, and the resulting mixture was allowed to react for one hour. Thereafter, the kettle was heated to 85° C. over a period of one hour, and the polymerization was continued at this temperature for 6 hours before cooling down to room temperature. The resulting mixture was then transferred to a 4 liter beaker, and diluted with water to a volume of about four liters with constant stirring. The encapsulated toner was allowed to settle to the bottom of the beaker by gravity, and the aqueous supernatant was carefully decanted. The washing was repeated in this manner three times until the washing was clear. The washed toner was transferred to a 2 liter beaker and diluted with water to a total of 1.8 liter. AQUADAQ GRAPHITE E TM (23.5 grams, from Acheson Colloids), and water (100 milliliters) were then added, and the mixture was spray dried in a Yamato Spray Dryer at an air inlet temperature of 160° C., and an outlet temperature of 80° C. The airflow was retained at 1.0 kilogram/cm$^2$. The collected dry encapsulated toner (370 grams) was screened through a 63 micron screen; the toner volume average particle diameter, as measured on a 256 channel Coulter Counter, was 16 microns with a volume average particle size dispersity of 1.34.

Two hundred and forty (240) grams of the above encapsulated toner was dry blended using a Grey blender, first with 0.96 gram of carbon black (BLACK PEARL 2000 TM) for two minutes at 3,500 RPM, and then with 3.6 grams of zinc stearate for an additional 10 minutes at 3,000 RPM to provide for the toner a volume resistivity of $1.1\times10^6$ ohm-cm.

The imaged fix, gloss level, remanence and MICR signal were evaluated as described in Example I, and for the encapsulated toner of this Example III the image fix level was 89 percent, the gloss level was 11 gloss units, the remanence was 1.5 gauss and the MICR signal was 7 percent.

EXAMPLE IV

A 17 micron low gloss and low remanence magnetic encapsulated toner comprised of a core comprised of poly(n-lauryl methacrylate), iron powder magnetite and a shell comprised of a polyurethane was prepared as follows.

A mixture of n-lauryl methacrylate (113 grams), 2,2'-azo-bis-(2,4-dimethyl-valeronitrile) (3.3 grams), 2,2'-azo-bis-(isobutyronitrile) (3.3 grams), ISONATE 143L TM (47.6 grams), iron powder (average particle size of 4.2 microns) (200 grams), carbon black (REGAL 330®) (3.5 grams), and titanium dioxide (85 grams) was homogenized in a 2 liter Nalgene container with a Brinkmann polytron at 4,000 RPM for 30 seconds. To the resulting mixture was added 1 liter, 0.10 percent (by weight), of an aqueous solution, and thereafter, the mixture was homogenized again at 9,000 RPM for two minutes. The resulting dispersion was transferred to a 2 liter kettle immersed in an oil bath, and equipped with a mechanical stirrer. To the kettle contents was then added a solution of 37 milliliters of 2-pentamethylene diamine (DYTEK A TM obtained from DuPont)in 80 milliliters of water, and the resulting mixture was allowed to react for one hour. Thereafter, the kettle was heated to 85° C. over a period of one hour, and the polymerization was continued at this temperature for 6 hours before cooling down to room temperature. The resulting mixture was then transferred to a 4 liter beaker, and diluted with water to a volume of about four liters with constant stirring. The encapsulated toner was allowed to settle to the bottom of the beaker by gravity, and the aqueous supernatant was carefully decanted. The washing was repeated in this manner three times until the washing was clear. The washed toner was transferred to a 2 liter beaker and diluted with water to a total of 1.8 liter. AQUADAQ GRAPHITE E TM (23.5 grams, from Acheson Colloids), and water (100 milliliters) were then added, and the mixture was spray dried in a Yamato Spray Dryer at an air inlet temperature of 160° C., and an outlet temperature of 80° C. The airflow was retained at 1.0 kilogram/cm$^2$. The collected dry encapsulated toner (340 grams) was screened through a 63 micron screen; the toner volume average particle diameter, as measured on a 256 channel Coulter Counter, was 17 microns with a volume average particle size dispersity of 1.36.

Two hundred and forty grams of the above encapsulated toner were dry blended using a Grey blender, first with 0.96 gram of carbon black (Black Pearl 2000 TM) for two minutes at 3,500 RPM, and then with 3.6 grams of zinc stearate for an additional 10 minutes at 3,000 RPM to provide for the toner a volume resistivity of $2.0\times10^6$ ohm-cm.

The imaged fix, gloss level, remanence, and MICR signal were evaluated as described in Example I, and for the encapsulated toner of this Example IV the image fix level was 93 percent, the gloss level was 10 gloss units, the remanence was 0.5 gauss and the MICR signal was 2 percent.

EXAMPLE V

A 17.5 micron low gloss and low remanence magnetic encapsulated toner comprised of a core comprised of poly(n-lauryl methacrylate), iron oxide magnetite and a shell comprised of a polyurethane was prepared as follows.

A mixture of n-lauryl methacrylate (113 grams), 2,2'-azo-bis-(2,4-dimethyl-valeronitrile) (3.3 grams), 2,2'-azo-bis-(isobutyronitrile) (3.3 grams), ISONATE 143L TM (47.6 grams), iron oxide (average particle size of 5.5 microns) (270 grams), and titanium dioxide (30 grams) was homogenized in a 2 liter Nalgene container with a Brinkmann polytron at 4,000 RPM for 30 seconds. To the resulting mixture was added 1 liter, 0.10 percent (by weight), of an aqueous solution, and thereafter, the mixture was homogenized again at 9,000 RPM for two minutes. The resulting dispersion was transferred to a 2 liter kettle immersed in an oil bath, and equipped with a mechanical stirrer. To the kettle contents were then added a solution of 37 milliliters of 2-pentamethylene diamine (DYTEK A TM obtained from DuPont) in 80 milliliters of water, and the resulting mixture was allowed to react for one hour. Thereafter, the kettle was heated to 85° C. over a period of one hour, and the polymerization was continued at this temperature for 6 hours before cooling down to room temperature. The resulting mixture was then transferred to a 4 liter beaker, and diluted with water to a volume of about four liters with constant stirring. The encapsulated toner was allowed to settle to the bottom of the beaker by gravity, and the aqueous supernatant was carefully decanted. The washing was repeated in this manner three times until the washing was clear. The washed toner was transferred to a 2 liter beaker and diluted with water to a total of 1.8 liter. AQUADAQ GRAPHITE E TM (23.5 grams, from Acheson Colloids), and water(100 milliliters) were then added, and the mixture was spray dried in a Yamato Spray Dryer at an air inlet temperature of 160° C., and an outlet temperature of 80° C. The airflow was retained at 1.0 kilogram/cm$^2$. The collected dry encapsulated toner (345 grams) was screened through a 63 micron screen; the toner volume average particle diameter, as measured on a 256 channel Coulter Counter, was 17.5 microns with a volume average particle size dispersity of 1.39.

Two hundred and forty grams of the above encapsulated toner were dry blended using a Grey blender, first with 0.96 gram of carbon black (BLACK PEARL 2000 TM ) for two minutes at 3,500 RPM, and then with 3.6 grams of zinc stearate for an additional 10 minutes at 3,000 RPM, to provide the toner with a volume resistivity of $1.0\times10^6$ ohm-cm.

The imaged fix, gloss level, remanence, and MICR signal were evaluated as described in Example I, and for the encapsulated toner of this Example the image fix level was 86 percent, the gloss level was 23 gloss units, the remanence was 6 gauss and the MICR signal was 18 percent.

EXAMPLE VI

A 15 micron low gloss and low remanence magnetic encapsulated toner comprised of a core comprised of poly(n-lauryl methacrylate), iron oxide magnetite and a shell comprised of a polyurethane was prepared as follows.

A mixture of n-lauryl methacrylate (113 grams), 2,2'-azo-bis-(2,4-dimethyl-valeronitrile) (3.3 grams), 2,2'-azo-bis-(isobutyronitrile) (3.3 grams), ISONATE 143L TM (47.6 grams), iron oxide (average particle size of 5.5 microns) (260 grams), and titanium dioxide (40 grams) was homogenized in a 2 liter Nalgene container with a Brinkmann polytron at 4,000 RPM for 30 seconds. To the resulting mixture was added 1 liter, 0.13 percent (by weight), of an aqueous solution, and thereafter, the mixture was homogenized again at 9,000 RPM for two minutes. The resulting dispersion was transferred to a 2 liter kettle immersed in an oil bath, and equipped with a mechanical stirrer. To the kettle contents were then added a solution of 37 milliliters of 2-pentamethylene diamine (DYTEK A TM obtained from DuPont) in 80 milliliters of water, and the resulting mixture was allowed to react for one hour. Thereafter, the kettle was heated to 85° C. over a period of one hour, and the polymerization was continued at this temperature for 6 hours before cooling down to room temperature. The resulting mixture was then transferred to a 4 liter beaker, and diluted with water to a volume of about four liters with constant stirring. The encapsulated toner was allowed to settle to the bottom of the beaker by gravity, and the aqueous supernatant was carefully decanted. The washing was repeated in this manner three times until the washing was clear. The washed toner was transferred to a 2 liter beaker and diluted with water to a total of 1.8 liter. AQUADAQ GRAPHITE E TM (23.5 grams, from Acheson Colloids), and water (100 milliliters) were then added, and the mixture was spray dried in a Yamato Spray Dryer at an air inlet temperature of 160° C., and an outlet temperature of 80° C. The airflow was retained at 1.0 kilogram/cm$^2$. The collected dry encapsulated toner (330 grams) was screened through a 63 micron screen; the toner volume average particle diameter, as measured on a 256 channel Coulter Counter, was 15 microns with a volume average particle size dispersity of 1.41.

Two hundred and forty grams of the above encapsulated toner were dry blended using a Grey blender, first with 0.96 gram of carbon black (BLACK PEARL 2000 TM ) for two minutes at 3,500 RPM, and then with 3.6 grams of zinc stearate for an additional 10 minutes at 3,000 RPM to provide for the toner a volume resistivity of $1.8\times10^6$ ohm-cm.

The imaged fix, gloss level, remanence and MICR signal were evaluated as described in Example I, and for the encapsulated toner of this Example the image fix level was 83 percent, the gloss level was 21 gloss units, the remanence was 6.5 gauss and the MICR signal was 21 percent.

Comparative Example III

A 15 micron low gloss and low remanence magnetic encapsulated toner comprised of a core comprised of poly(n-lauryl methacrylate), iron oxide magnetite (MAPICO BLACK ®) and a shell comprised of a polyurethane was prepared as follows.

A mixture of n-lauryl methacrylate (113 grams), 2,2'-azo-bis-(2,4-dimethyl-valeronitrile) (3.3 grams), 2,2'-azo-bis-(isobutyronitrile) (3.3 grams), ISONATE 143L TM (47.6 grams), and iron oxide MAPICO BLACK ® (of average particle volume diameter of 0.2 micron, available from Columbian Chemicals) (300 grams) was homogenized in a 2-liter Nalgene container with a Brinkmann polytron at 4,000 RPM for 30 seconds. To the resulting mixture was added 1 liter, 0.10 percent (by weight), of an aqueous solution, and thereafter, the mixture was homogenized again at 9,000 RPM for two minutes. The resulting dispersion was transferred to a 2 liter kettle immersed in an oil bath, and equipped with a mechanical stirrer. To the kettle contents was then added a solution of 37 milliliters of 2-pentamethylene diamine (DYTEK A TM obtained from DuPont)in 80 milliliters of water, and the resulting mixture was allowed to react for one hour. Thereafter, the kettle was heated to 85° C. over a period of one hour, and the polymerization was continued at this temperature for 6 hours before cooling down to room temperature. The resulting mixture was then transferred to a 4 liter beaker, and diluted with water to a volume of about four liters with constant stirring. The encapsulated toner was allowed to settle to the bottom of the beaker by gravity, and the aqueous supernatant was carefully decanted. The washing was repeated in this manner three times until the washing was clear. The washed toner was transferred to a 2 liter beaker and diluted with water to a total of 1.8 liter. AQUADAQ GRAPHITE E TM (23.5 grams, from Acheson Colloids) and water (100 milliliters) were then added, and the mixture was spray dried in a Yamato Spray Dryer at an air inlet temperature of 160° C., and an outlet temperature of 80° C. The airflow was retained at 1.0 kilogram/cm$^2$. The collected dry encapsulated toner (377 grams) was screened through a 63 micron screen; the toner volume average particle diameter, as measured on a 256 channel Coulter Counter, was 15 microns with a volume average particle size dispersity of 1.41.

Two hundred and forty (240) grams of the above encapsulated toner were dry blended using a Grey blender, first with 0.96 gram of carbon black (BLACK PEARL 2000 TM) for two minutes at 3,500 RPM, and then with 3.6 grams of zinc stearate for an additional 10 minutes at 3,000 RPM to provide for the toner a volume resistivity of $1.3\times10^6$ ohm-cm.

The pressure fixing ionographic printer elected for the testing of this toner was the Xerox 4060 printer. The developed images were transfixed at a pressure of 2,000 psi. Print quality was evaluated from a checkerboard print pattern. The image optical density was measured using a standard integrated densitometer. Image fix was measured by the standardized tape pull method wherein a tape was pressed with a uniform reproducible standard pressure against an image and then removed. The imaged fix level is expressed as a percentage of the retained image optical density after the tape test, relative to the original image optical density. For the encapsulated toner of this Comparative Example III, the image fix level was 91 percent.

The gloss level was measured on a 1 square inch toner image after fixing by utilizing a Gloss Gardner meter. The gloss level for the encapsulated toner of this Comparative Example III was 58 gloss units. Additionally, the remanence of this toner was measured to be 18 gauss units. MICR characters were then generated using an E-13 B font (the standard used by the MICR industry in the United States as set by ANSI (American National Standard Institute), and were printed on the aforementioned Xerox 4060 printer. The magnetic strength for MICR was tested using the MICR-MATE 1 magnetic signal tester from Checkmate Electronics. The average magnetic signal strength (as a percentage of the nominal strength) for the MICR characters was used for the evaluation. The specifications for MICR magnetic strength is set by ANSI. The acceptable range is 50 to 200 percent of the nominal in the United States, and 80 to 200 percent of the nominal in Canada. It is preferred to print checks with an average signal level of about 100 percent or slightly larger for MICR uses. For nonmagnetic character readings, a signal level of below 30 percent, and more preferably around 0 percent is necessary. For the encapsulated toner of this Comparative Example III, the MICR signal was 65 percent, thus this toner is not acceptable by ANSI standards for use in a nonmagnetic character reading process.

Comparative Example IV

A 19.5 micron low gloss and low remanence magnetic encapsulated toner comprised of a core comprised of poly(n-lauryl methacrylate), iron oxide magnetite (NP608 ®) and a shell comprised of a polyurethane was prepared as follows.

A mixture of n-lauryl methacrylate (113 grams), 2,2'-azo-bis-(2,4-dimethyl-valeronitrile) (3.3 grams), 2,2'-azo-bis-(isobutyronitrile) (3.3 grams), ISONATE 143L TM (47.6 grams), and iron oxide NP608 ® (of average particle volume diameter of 0.6 micron, available from Northern Pigment) (300 grams) was homogenized in a 2 liter Nalgene container with a Brinkmann polytron at 4,000 RPM for 30 seconds. To the resulting mixture was added 1 liter, 0.10 percent (by weight), of an aqueous solution, and thereafter, the mixture was homogenized again at 9,000 RPM for two minutes. The resulting dispersion was transferred to a 2 liter kettle immersed in an oil bath, and equipped with a mechanical stirrer. To the kettle contents were then added a solution of 37 milliliters of 2-pentamethylene diamine (DYTEK A TM obtained from DuPont) in 80 milliliters of water, and the resulting mixture was allowed to react for one hour. Thereafter, the kettle was heated to 85° C. over a period of one hour, and the polymerization was continued at this temperature for 6 hours before cooling down to room temperature. The resulting mixture was then transferred to a 4 liter beaker, and diluted with water to a volume of about four liters with constant stirring. The encapsulated toner was allowed to settle to the bottom of the beaker by gravity, and the aqueous supernatant was carefully decanted. The washing was repeated in this manner three times until the washing was clear. The washed toner was transferred to a 2 liter beaker and diluted with water to a total of 1.8 liter. AQUADAQ GRAPHITE E TM (23.5 grams, from Acheson Colloids), and water (100 milliliters) were then added, and the mixture was spray dried in a Yamato Spray Dryer at an air inlet temperature of 160° C., and an outlet temperature of 80° C. The airflow was retained at 1.0 kilogram/cm$^2$. The collected dry encapsulated toner (3,630 grams) was screened through a 63 micron screen; the toner volume average particle diameter, as measured on a 256 channel Coulter Counter, was 19.5 microns with a volume average particle size dispersity of 1.47.

Two hundred and forty (240) grams of the above encapsulated toner were dry blended using a Grey blender, first with 0.96 gram of carbon black (BLACK PEARL 2000 TM) for two minutes at 3,500 RPM, and then with 3.6 grams of zinc stearate for an additional 10 minutes at 3,000 RPM to provide a toner with a volume resistivity of $1.9\times10^6$ ohm-cm.

The pressure fixing ionographic printer elected for the testing of this toner was the Xerox 4060 printer. The developed images were transfixed at a pressure of 2000 psi. Print quality was evaluated from a checkerboard print pattern. The image optical density was measured using a standard integrated densitometer. Image fix was measured by the standardized tape pull method wherein a tape was pressed with a uniform reproducible standard pressure against an image and then removed. The imaged fix level is expressed as a percentage of the retained image optical density after the tape test, relative to the original image optical density. For the encapsulated toner of this Comparative Example IV, the image fix level was 88 percent.

The gloss level was measured on a 1 square inch toner image after fixing by utilizing a Gloss Gardner meter. The gloss level for the encapsulated toner of this Comparative Example was 61 gloss units. Additionally, the remanence of this toner was measured to be 17 gauss units. MICR characters were then generated using an E-13 B font (the standard used by the MICR industry in the United States as set by ANSI (American National Standard Institute), and were printed on the aforementioned Xerox 4060 printer. The magnetic strength for MICR was tested using the MICR-MATE 1 magnetic signal tester from Checkmate Electronics. The average magnetic signal strength (as a percentage of the nominal strength) for the MICR characters was used for the evaluation. The specifications for MICR magnetic strength is set by ANSI. The acceptable range is 50 to 200 percent of the nominal in the United States, and 80 to 200 percent of the nominal in Canada. It is preferred to print checks with an average signal level of about 100 percent or slightly larger for MICR uses. For nonmagnetic character readings, a signal level of below 30 percent, and more preferably around 0 percent is necessary. For the encapsulated toner of this Comparative Example, the MICR signal was 60 percent, thus this toner is not acceptable by ANSI standards for use in a nonmagnetic character reading process.

For imaging and security imaging and printing, including MICR process, there can be selected the toners of the present invention or mixtures of the toners of the present invention and known magnetic toners free of encapsulation, which mixture can contain from about 20 to about 80 percent of the encapsulated toner.

Other modifications of the present invention may occur to those skilled in the art subsequent to a review of the present application. The aforementioned modifications, including equivalents thereof, are intended to be included within the scope of the present invention.

What is claimed is:

1. A toner composition consisting essentially of a core consisting essentially of a blended mixture of a polymer resin or resins, low remanence magnetite of from between about 0.1 to about 8 gauss with an average volume particle diameter of from between about 2 to about 6 microns, and a light scattering component with an average particle diameter of from between about 2 to about 6 microns; and which core is encapsulated in a polymeric shell; and wherein said light scattering component is selected from the group consisting of calcium oxide, titanium oxide, titanium dioxide, alumina, barium sulfate, calcium sulfate, mica, calcium titanate, barium titanate, magnesium titanate, strontium titanate, zirconium titanate, barium zirconate, cerium oxide, silicone nitride, clay, siliceous sand, zinc oxide, zinc stearate, calcium carbonate, magnesium oxide, zinc stearate, and mixtures thereof.

2. A toner in accordance with claim 1 wherein the polymer core resin is an acrylate polymer, a methacrylate polymer, a styrene-acrylate polymer or a styrene-methacrylate polymer.

3. A toner in accordance with claim 2 which displays a gloss of from about 4 to about 15 gloss units after fixing.

4. A toner in accordance with claim 1 which displays a gloss of from about 1 to about 25 gloss units after fixing.

5. A toner in accordance with claim 1 wherein the shell is comprised of a polyurea, a polyurethane, a polyamide, a polyester, or a polyether resin.

6. A toner in accordance with claim 1 wherein the magnetite has an average volume particle diameter of from between 4 to about 6 microns.

7. A toner in accordance with claim 1 wherein the magnetite has a low remanence of from about 0.1 gauss to about 5 gauss.

8. A toner in accordance with claim 1 wherein the light scattering component has an average particle diameter of from between about 4 and about 6 microns.

9. A toner in accordance with claim 1 wherein the core resin is present in an amount of from about 60 percent to about 85 percent by weight of the toner, the magnetite is present in an amount of from about 3 percent to about 10 percent by weight of toner, the light scattering deglosser is present in an amount of from about 1 to about 10 percent, and the shell is present in an amount of from about 10 percent to about 30 percent of the toner.

10. A toner in accordance with claim 1 wherein the polymer resin is derived from the polymerization of addition monomers selected from the group consisting of methyl acrylate, methyl methacrylate, ethyl acrylate, ethyl methacrylate, propyl acrylate, propyl methacrylate, butyl acrylate, butyl methacrylate, pentyl acrylate, pentyl methacrylate, hexyl acrylate, hexyl methacrylate, heptyl acrylate, heptyl methacrylate, octyl acrylate, octyl methacrylate, cyclohexyl acrylate, cyclohexyl methacrylate, lauryl acrylate, lauryl methacrylate, stearyl acrylate, stearyl methacrylate, benzyl acrylate, benzyl methacrylate, ethoxypropyl acrylate, ethoxypropyl methacrylate, methylbutyl acrylate, methylbutyl methacrylate, ethylhexyl acrylate, ethylhexyl methacrylate, methoxybutyl acrylate, methoxybutyl methacrylate, cyanobutyl acrylate, cyanobutyl methacrylate, tolyl acrylate, tolyl methacrylate, styrene, and substituted styrenes.

* * * * *